United States Patent [19]

Ishige et al.

[11] 4,132,436

[45] Jan. 2, 1979

[54] RECORDING MATERIAL

[75] Inventors: Sadao Ishige; Hideo Usui, both of Minami-ashigara; Keiso Saeki, Fujimiya, all of Japan

[73] Assignee: Fuji Photo Film Co., Ltd., Minami-ashigara, Japan

[21] Appl. No.: 764,618

[22] Filed: Feb. 1, 1977

[30] Foreign Application Priority Data

Feb. 4, 1976 [JP] Japan ..... 51-11074

[51] Int. Cl.[2] ..... B41M 5/22; B41M 5/18

[52] U.S. Cl. ..... 282/27.5; 106/21; 427/151; 427/153; 428/307; 428/913; 428/914

[58] Field of Search ..... 282/27.5; 260/243 R; 427/146, 150, 151, 153; 428/411, 537, 913, 914, 307; 106/21

[56] References Cited

U.S. PATENT DOCUMENTS

| | | | |
|---|---|---|---|
| 2,915,415 | 12/1959 | Francis et al. | 260/243 A |
| 3,417,085 | 12/1968 | Kuch et al. | 544/50 |
| 3,427,180 | 2/1969 | Phillips | 428/306 X |
| 3,586,675 | 6/1971 | Ritchie et al. | 544/47 |
| 3,900,217 | 8/1975 | Hayashi et al. | 282/27.5 |

FOREIGN PATENT DOCUMENTS

| | | | |
|---|---|---|---|
| 67/6886 | 4/1968 | South Africa | 427/151 |

*Primary Examiner*—George F. Lesmes

*Assistant Examiner*—Bruce H. Hess

*Attorney, Agent, or Firm*—Sughrue, Rothwell, Mion, Zinn and Macpeak

[57] ABSTRACT

A recording material comprising (1) at least one thiazine compound capable of forming a color when contacted with an electron accepting material and represented by the following general formula (I):

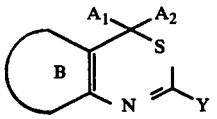

(I)

wherein $A_1$ and $A_2$, which may be the same or different, each represents an aryl group or a hetero ring residue or, when taken together, $A_1$ and $A_2$ represent a hetero ring or a fluorene ring; ring B represents an aromatic hydrocarbon ring or a hetero ring; and Y represents a hydrogen atom, an alkyl group, an aralkyl group, an alkenyl group, an alkynyl group, an aryl group, a hetero ring residue, an amino group, an amido group, a hydroxy group or a thio group; provided that at least one of $A_1$ and $A_2$ or, when $A_1$ and $A_2$ are taken together, the ring formed by $A_1$ and $A_2$, is an electron donating aryl group, an electron donating hetero ring residue or an electron donating fluorene ring residue; and (2) an electron accepting material.

16 Claims, No Drawings

RECORDING MATERIAL

BACKGROUND OF THE INVENTION

1. Field of the Invention

The present invention relates to a recording material and, more particularly, to a recording material such as a pressure-sensitive copying paper, a heat-sensitive recording paper, a light-sensitive recording sheet, etc., capable of providing color images which have excellent light resistance.

2. Description of the Prior Art

A large number of systems have been suggested for recording information using as a stimulus energy such as pressure, heat, light, electricity, etc. However, quite few systems have in actuality been put into practice.

The recording system employed for commercially available pressure-sensitive copying papers, heat-sensitive copying papers and electrothermic heat-sensitive recording papers utilizes the phenomenon that colors are formed by bringing a dye precursor or an electron-donating material (also called a "color former", which is a substantially colorless organic compound capable of reacting with an electron-accepting material, to be described hereinafter, to form a color) into contact with an electron-accepting material (also called a "color developer", which is a material acting as a Bronsted acid or a Lewis acid, such as clay minerals (e.g., activated clay, etc.); organic acids (e.g., phenols, phenolic resins, organic carboxylic acids, organic sulfonic acids, etc.); metal salts of phenols, organic carboxylic acids or organic sulfonic acids (e.g., salts of Al, Zn, Ni, Sn, etc.); inorganic acids (e.g., hydrohalic acids, boric acid, silicic acid, phosphoric acid, sulfuric acid, nitric acid, perchloric acid, etc.); halides of Al, Zn, Ni, Sn, Ti, B, etc.) due to the application of pressure or heat or of electrical energy (with at least one of the color former and the color developer forming the contact as a solution, a liquid or a gas).

Of light-sensitive recording sheets, only a diazo light-sensitive paper is generally used in addition to silver salt light-sensitive materials as an inexpensive light-sensitive recording sheet. With respect to light-sensitive recording sheets, too, systems combining a dye precursor of an electron-donating material with a compound capable of forming an electron accepting material which is a solid acid when exposed by light have been suggested and are described in Japanese Patent Publications 24188/63 corresponding to U.S. Pat. No. 3,140,947, 10550/70 corresponding to U.S. application Ser. No. 533,869, filed Mar. 14, 1966, 13258/70 corresponding to U.S. application Ser. No. 502,498, filed Oct. 22, 1965, 6212/74, 28449/74, Japanese Patent applications (OPI), 80120/75, 87317/75, 126228/75, etc. However, these systems have not been put into practice.

Dye precursors capable of forming a color when brought into intimate contact with an electron accepting material have heretofore been studied mainly as color formers for pressure-sensitive copying papers. The properties required for color formers to be used for pressure-sensitive copying paper vary over a wide range. The main requirements as to the properties of color formers are that they (1) be substantially colorless; (2) be capable of forming color almost instantly when in contact with an electron accepting material; (3) be soluble in a certain organic solvent; (4) do not sublime; (5) do not undergo decomposition or coloration in the air due to light, heat or humidity before being brought into contact with an electron accepting material; (6) form a dye with the help of an electron accepting material, which dye is resistant to light, heat or humidity; (7) be non-toxic and do not cause environmental pollution; (8) be inexpensive to synthesize on an industrial scale; and the like.

At present, there are no color formers that satisfy all of these requirements, and the fact is that two or more color formers are used in combination or a specific electron accepting material is selected to compensate to some extent for the properties in which the color formers are deficient.

Color formers for pressure-sensitive copying papers are required to possess so many properties, each of which should be exhibited to a high degree, that color formers which can be used for pressure-sensitive copying papers are naturally expected to be also usable as dye precursors for the abovedescribed heat-sensitive recording papers, electrothermic heat-sensitive recording papers, light-sensitive sheets, etc., which utilize coloration by the reaction between an electron donating material and an electron accepting material. In fact, dye precursors used in commercially available heat-sensitive recording papers and electrothermic heat-sensitive recording papers are those used as color formers for pressure-sensitive copying papers.

In addition, dye precursors for light-sensitive recording sheets described in the foregoing patents are mostly known as color formers for pressure-sensitive copying paper. Furthermore, also the intentions are to apply color formers for pressure-sensitive copying paper to ultrasonic wave recording papers (French Pat. No. 2,120,922), electron beam recording materials (Belgian Pat. No. 7,959,986), electrostatic recording papers (Japanese Patent Publication 3932/74), formation of dye images on light-sensitive printing plate materials (Japanese Patent Application (OPI) 12104/73), color former inks (Japanese Patent Publication 10766/72), typewriter ribbons (Japanese Patent Application (OPI) 3713/74), inks for ball point pens (Japanese Patent Application (OPI) 83924/73), crayons (U.S. Pat. No. 3,769,045), etc.

A large number of patents have issued on color formers for pressure-sensitive copying papers. However, there are known no color formers that satisfy the above-described requirements (2), (5) and (6), much less satisfy all eight requirements set forth above. Crystal violet lactone having the structural formula (A):

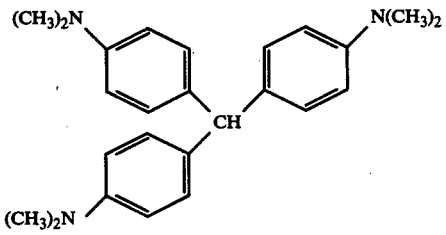

(A)

at present used as a blue color former satisfies requirements (2) and (5), but does not satisfy requirement (6). Therefore, this compound is used in combination with N-benzoylleucomethylene blue having the structural formula (B):

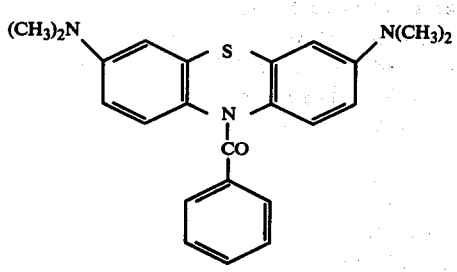

(B)

which satisfies requirement (6) but which does not satisfy requirements (2) and (5).

However, since the coloration hue of these two color formers of the formulae (A) and (B) above differs from each other, it is necessary to add another color former to adjust the coloration hue. Therefore, this process is economically disadvantageous and, in addition, there is the defect that the color formers form a color when exposed to light befor use.

As red and black color formers, fluoran color formers as represented by the following formula (C):

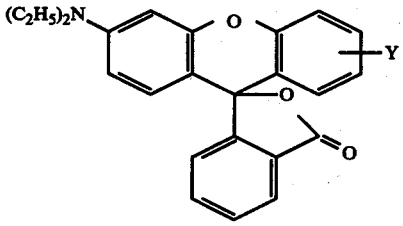

(C)

can be used.

These color formers have the disadvantage that the color density, hue and light resistance vary greatly depending upon the kind of electron accepting materials, especially between activated clay and a phenol resin with which they are used. Ideal electron accepting materials have not been discovered. For example, activated clay provides poor light resistance, although it provides a high color density, whereas a phenol resin generally provides good light resistance but provides a low color density.

Some color formers as used for pressure-sensitive copying papers are also used as color formers for heat-sensitive recording papers and electrotheric heat-sensitive recording papers. In these cases, however, problems with respect to light resistance and fog prevention before coloration (stain in the background) exist. The main reason therefor is that requirements (5) and (6) required for color formers for pressure-sensitive copying papers are not fully satisfied.

A light-sensitive recording sheet can be obtained by coating a compound capable of forming an electron accepting material (e.g., a hydrogen halide like hydrogen chloride, hydrogen bromide, hydrogen iodide, etc.; a carboxylic acid; a sulfonic acid; a phenol), such as organic halides (e.g., carbon tetrabromide, $\alpha,\alpha,\alpha$-tribromoacetophenone, hexachloroethane, iodoform, 2-tribromomethylpyridine, trichloromethylsulfonylbenzene, etc.; o-quinonediazide compounds as described in Japanese Patent Application (OPI) 12104/73; phenol esters of a carboxylic acid or a sulfonic acid capable of undergoing a photochemical Fries rearrangement), and an electron donating dye precursor (color former for a pressure-sensitive copying paper) on a support of a paper or a synthetic resin film together with a suitable binder. However, conventional dye precursors have the defects that the resulting color images have poor light resistance, and that the occurrence of fog before coloration is serious while the color density in the light-irradiated areas is low.

In addition, application to ultrasonic wave recording papers, electron beam recording papers, electrostatic recording papers, light-sensitive printing plate materials, color former inks, typewriter ribbons, inks for ball point pens, crayons, etc., involves the problems that the density and light fastness of the resulting color images are insufficient, and that fog is formed during storage before use and coloration upon use is poor, since conventional dye precursors (color formers) do not sufficiently satisfy, in particular, requirements (2), (5) and (6) of the requirements for pressure-sensitive copying paper as described before.

SUMMARY OF THE INVENTION

Therefore, investigations on improvement of color formers mainly for pressure-sensitive copying paper have now been conducted in order to improve the properties of various recording materials as described hereinbefore which involve coloration by the reaction between an electron donating material and an electron accepting material.

That is, an object of the present invention is to provide a recording material (e.g., a pressure-sensitive copying paper, a heat-sensitive recording paper, an electrothermic heat-sensitive recording paper, a light-sensitive recording sheet, an ultrasonic wave recording paper, an electron beam recording paper, an electrostatic recording paper, a light-sensitive printing plate material, a color former ink, a typewriter ribbon, an ink for ball point pens, a crayon, etc.) capable of providing color images having improved light resistance.

Another object of the present invention is to provide the above-described recording material, whose storability before use is excellent and whose coloring ability is not reduced, and which does not cause fog.

These objects have been attained by using, as a color former, at least one thiazine derivative represented by the following general formula (I) as a dye precursor:

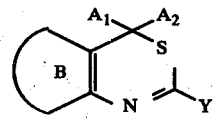

(I)

wherein $A_1$ and $A_2$, which may be the same or different, each represents an aryl group or a hetero ring residue or, when taken together, $A_1$ and $A_2$ represent a hetero ring or a fluorene ring; ring B represents an aromatic hydrocarbon ring or a hetero ring; and Y represents a hydrogen atom, an alkyl group, an aralkyl group, an alkenyl group, an alkynyl group, an aryl group, a hetero ring residue, an amino group, an amido group, a hydroxy group or a thio group; provided that at least one of $A_1$ and $A_2$ or, when $A_1$ and $A_2$ are taken together, the ring formed by $A_1$ and $A_2$, is an electron donating aryl group, an electron donating hetero ring residue or an electron donating fluorene ring residue; and (2) an electron accepting material.

Accordingly, this invention provides a recording material comprising (1) at least one thiazine compound capable of forming a color when contacted with an electron accepting material and represented by the following general formula (I):

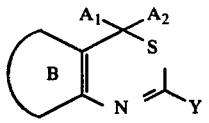

(I)

wherein $A_1$ and $A_2$, which may be the same or different, each represents an aryl group or a hetero ring residue or, when taken together, $A_1$ and $A_2$ represent a hetero ring or a fluorene ring; ring B represents an aromatic hydrocarbon ring or a hetero ring; and Y represents a hydrogen atom, an alkyl group, an aralkyl group, an alkenyl group, an alkynyl group, an aryl group, a hetero ring residue, an amino group, an amido group, a hydroxy group or a thio group; provided that at least one of $A_1$ and $A_2$ or, when $A_1$ and $A_2$ are taken together, the ring formed by $A_1$ and $A_2$, is an electron donating aryl group, an electron donating hetero ring residue or an electron donating fluorene ring residue; and (2) an electron accepting material.

DETAILED DESCRIPTION OF THE INVENTION

In the above general formula (I), $A_1$ and $A_2$, which may be the same or different, each represents an aryl group (e.g., a phenyl group, a naphthyl group, a biphenylyl group, a substituted phenyl group, a substituted naphthyl group, a substituted biphenylyl group, etc. (in which the substituents can be one or more of an alkyl group (e.g., containing 1 to 6 carbon atoms such as a methyl group, an ethyl group, a propyl group, a butyl group, a cyclohexyl group, etc.), a fluoroalkyl group (e.g., containing 1 to 6 carbon atoms such as a trifluoromethyl group, etc.), an aralkyl group (e.g., containing 7 to 15 carbon atoms such as a benzyl group, an α-methylbenzyl group, an α,α-dimethylbenzyl group, a 1,1-diphenylethyl group, a naphthylmethyl group, a phenethyl group, etc.), a halogen atom (e.g., a fluorine atom, a chlorine atom, a bromine atom, an iodine atom, etc.), an alkoxy group (e.g., containing 1 to 6 carbon atoms such as a methoxy group, an ethoxy group, a propoxy group, a butoxy group, a cyclohexyloxy group, etc.), an aralkyloxy group (e.g., containing 7 to 15 carbon atoms such as a benzyloxy group, a phenethyloxy group, a naphthylmethyloxy group, etc.), an aryloxy group (e.g., containing 6 to 12 carbon atoms such as a phenoxy group, a naphthoxy group, etc.), a heteroaryloxy group (e.g., containing 2 to 12 carbon atoms such as an α-pyridyloxy group, a γ-pyridyloxy group, an α-furyloxy group, a β-furyloxy group, an α-thienyloxy group, a β-thienyloxy group, a 2-pyrimidinyloxy group, a 2-triazinyloxy group, etc.), an alkenyloxy group (e.g., containing 3 to 7 carbon atoms such as an allyloxy group, an isopropenyloxy group, etc.), an alkynyloxy group (e.g., containing 2 to 7 carbon atoms such as an ethynyloxy group, a propargyloxy group, etc.), a substituted alkyloxy group (e.g., containing 3 to 9 carbon atoms such as an acetonyloxy group, a phenacyloxy group, an ethoxycarbonylmethyloxy group, an N,N-diethylcarbamoylmethyloxy group, an acetonylmethyloxy group, a β-ethoxycarbonylethyloxy group, a β-(N,N-dimethylamino)ethyloxy group, a β-methoxyethyloxy group, a β-cyanoethyloxy group, a β-chloroethyloxy group, a β-methanesulfonylethyloxy group, etc.), an acyloxy group (e.g., an acetoxy group, a benzoyloxy group, a 2-pyridinecarbonyloxy group, an ethoxycarbonyloxy group, etc.), a sulfonyloxy group (e.g., a methanesulfonyloxy group, a p-toluenesulfonyloxy group, etc.), an amino group (e.g., an amino group, an anilino group, an ethylamino group, a benzylamino group, an allylamino group, a propargylamino group, a cyclohexylamino group, an acetonylamino group, an ethoxycarbonylmethylamino group, a β-methoxyethylamino group, a dimethylamino group, a diethylamino group, a dibenzylamino group, a bis(ethoxymethyl)amino group, a bis(β-chloroethyl)amino group, a bis(β-cyanoethyl)amino group, an N-benzyl-N-ethylamino group, an N-ethyl-N-(p-tolyl)amino group, an N-benzyl-N-(β-ethoxyethyl)amino group, an N-methyl-N-phenacylamino group, a morpholino group, a piperidino group, a pyrrolidino group, an α-pyridylamino group, a β-furylamino group, an α-thienylamino group, a 2-pyrimidinylamino group, etc.), an amido group (e.g., an acetamido group, a benzamido group, an α-pyridinecarboxyamido group, a butoxycarbonylamino group, a 3,3-diethylureido group, an N-ethylacetamido group, a p-toluenesulfonamido group, an N-butylmethanesulfonamido group, a benzthioamido group, a 3,3-diethylthioureido group, etc.), a thio group (e.g., a methylthio group, an ethylthio group, a butylthio group, a benzylthio group, etc.), etc.) or a hetero ring residue (for example, a 5- or 6-membered hetero ring residue containing at least one of a nitrogen, oxygen and sulfur atom as a hetero atom, such as p-julolidyl, 1,2,3,4-tetrahydroquinolin-6-yl, 3,3-dimethylindolin-5-yl, 3,4-methylenedioxyphenyl, 1,2-dimethyl-5-benzimidazolyl, 10-ethylphenothiazin-3-yl, 10-ethylphenoxazin-3-yl, 9-ethylcarbazol-3-yl, dibenzofuran-3-yl, dibenzothiophen-3-yl, quinolin-8-yl, 1,2-dimethylindol-3-yl, 1-ethylindazol-3-yl, benzo[b]furan-3-yl, benzo[b]thiophen-3-yl, 1-ethylpyrrol-3-yl, 3-furyl, 3-thienyl, 2-thiazolyl, 2-benzoxazolyl, 2-pyridyl, 4-quinolyl, etc., which may be unsubstituted or substituted with a substituent or substituents illustrated above with respect to the aryl group represented by $A_1$ or $A_2$) or, when taken together, $A_1$ and $A_2$ represent a hetero ring (e.g., 9H-xanthene (1), 10-alkyl-9,10-dihydroacridine (2), 9H-thioxanthene (3), 1-alkyl-4H-chromeno[2,3-C]pyrazole (4), 11H-benzo[b]thieno[3,2-b]chromene (5), 6-alkyl-5-oxo-5,6-dihydro-12H-chromeno[2,3-C]isoquinoline (6), 4H-chromene (7), 2H-chromene (8), etc., in which the numerals in parentheses above following the compound designated correspond to the structural formulas as illustrated below:

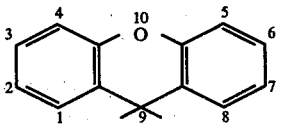

(1)

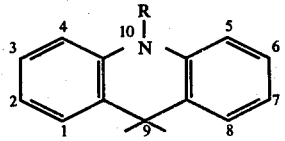

(2)

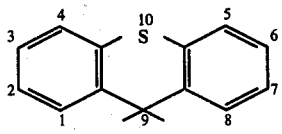

(3)

-continued (4)

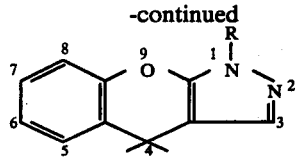

(5)

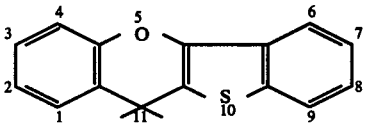

(6)

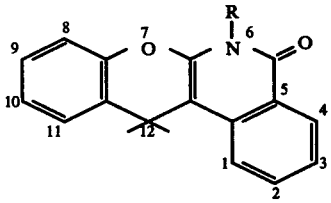

(7)

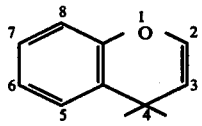

(8)

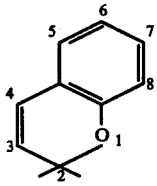

which may be unsubstituted or substituted with a substituent or substituents illustrated above with respect to the aryl group represented by $A_1$ or $A_2$) or a fluorene ring (which may be unsubstituted or substituted with a substituent or substituents illustrated above with respect to the aryl group represented by $A_1$ or $A_2$). In the above illustrated formulae, R in formulae (2), (4) and (6) represents an alkyl group (e.g., containing 1 to 18 carbon atoms), an aryl group (e.g., containing 6 to 15 carbon atoms) or an aralkyl group (e.g., containing 7 to 15 carbon atoms).

Ring B represents an aromatic hydrocarbon ring (for example, containing 6 to 15 carbon atoms such as benzene, naphthalene, biphenyl, tetralin, etc., which may be unsubstituted or substituted with a substituent or substituents illustrated above with respect to the aryl group represented by $A_1$ or $A_2$) or a hetero ring (for example, a 5- or 6-membered hetero ring containing at least one of a nitrogen, oxygen and sulfur atom as a hetero atom, such as pyrrole, furan, thiophene, indole, benzofuran, benzothiophene, carbazole, dibenzofuran, dibenzothiophene, julolidine, tetrahydroquinoline, benzimidazole, benzoxazole, benzothiazole, 1,3-benzo[d]dioxazole, etc., which may be unsubstituted or substituted with a substituent or substituents as illustrated above with respect to the aryl group represented by $A_1$ or $A_2$), and Y represents a hydrogen atom, an alkyl group (for example, an acyclic or cyclic alkyl group having 1 to 18 carbon atoms, such as a methyl group, an ethyl group, a propyl group, a butyl group, a hexyl group, an octyl group, a dodecyl group, an octadecyl group, a cyclopentyl group, a cyclohexyl group, or a substituted acyclic or cyclic alkyl group as described above substituted with one or more substituents such as a halogen atom, an alkoxy group (e.g., containing 1 to 6 carbon atoms), a dialkylamino group (e.g., containing 2 to 12 carbon atoms), a cyano group, etc.), an aralkyl group (e.g., containing 7 to 15 carbon atoms such as a benzyl group, an α-methylbenzyl group, an α,α-dimethylbenzyl group, a 1,1-diphenylethyl group, a naphthylmethyl group, a phenethyl group, etc.), an alkenyl group (e.g., containing 3 to 7 carbon atoms such as an allyl group, an isopropenyl group, a 2-butenyl group, a cyclohexenyl group, a cinnamyl group, etc.), an alkynyl group (e.g., containing 2 to 7 carbon atoms such as an ethynyl group, a propargyl group, a 2-butynyl group, etc.), an aryl group (e.g., as described for the aryl group represented by $A_1$ and $A_2$), a hetero ring residue (e.g., as described for the hetero ring residue represented by $A_1$ and $A_2$), an amino group (e.g., an unsubstituted amino group; a mono-alkyl- (e.g., containing 1 to 18 carbon atoms), mono-aralkyl- (e.g., containing 7 to 15 carbon atoms), mono-alkenyl- (e.g., containing 3 to 7 carbon atoms), and mono-alkynyl- (e.g., containing 2 to 7 carbon atoms) amino groups such as an ethylamino group, a butylamino group, an octadecylamino group, a cyclohexylamino group, a benzylamino group, a diphenylmethylamino group, a naphthylmethylamino group, a phenethylamino group, an allylamino group, a 2-butenylamino group, a 3-butenylamino group, a cyclohexenylamino group, a propargylamino group, etc.; mono-arylamino groups (e.g., containing 6 to 15 carbon atoms) such as an anilino group, a toluidino group, an anisidino group, a xylidino group, a p-nitrophenylamino group, a p-bromophenylamino group, an α-naphthylamino group, etc.; a mono-heteroarylamino group such as a pyridylamino group, a quinolylamino group, an acridinylamino group, a benzothiazolylamino group, a triazinylamino group, a furylamino group, a thienylamino group, etc.; a mono(substituted alkyl)-amino group such as a β-(N,N-dimethylamino)ethylamino group, a β-methoxyethylamino group, a β-cyanoethylamino group, a β-chloroethylamino group, an ethoxycarbonylmethylamino group, a cyanomethylamino group, an ethoxymethylamino group, an ethylthiomethylamino group, a 4-(methylthio)butylamino group, a trifluoromethylamino group, a 2-thiazolylmethylamino group, a (p-tolylsulfonyl)methylamino group, a 1,1-dimethyl-3-oxo-butylamino group, etc.; a mono-silylamino group such as a trimethylsilylamino group, a triphenylsilylamino group, a trimethoxysilylamino group, etc.; a di-substituted amino group such as a diethylamino group, a dibenzylamino group, a diphenylamino group, an N-benzyl-N-ethylamino group, an N-ethyl-N-phenylamino group, a bis(β-methoxyethyl)amino group, etc.; a cyclic amino group (e.g., containing 4 to 9 carbon atoms) such as a morpholino group, a piperidino group, a piperadino group, a pyrrolidino group, a tetrahydroquinolino group, etc.), an amido group (e.g., a carbonylamino group such as an acetamido group, a trifluoroacetamido group, a cyclohexanecarboxamido group, a benzamido group, an α-pyridinecarboxamido group, an α-furancarboxamido group, a butoxycarbonylamino group, a (butylthio)carbonylamino group, a 3,3-diethylureido group, etc.; a thiocarbonylamino group such as a benzothioamido group, a 3,3-diethylthioureido group, an α-thienylthiocarbonylamino group, a butoxythiocarbonylamino group, etc.; a sulfonamido group such as a methanesulfonamido group, a p-toluenesulfonamido group, a dimethylaminosulfonylamino group, etc.; an imidoylamino group such as an (N-phenylbenzimidoyl)amino group, an (N-phenyltrimethylacetoimidoyl)amino group, an (N-methylbenzimidoyl)amino group, an [N-(4-methoxyphenyl)benzimidoyl]amino group, an (N-phenyl-4-chlorobenzimidoyl)amino group, etc.), an oxy group (e.g., a hydroxy group, an alkoxy group (e.g., containing 1 to 6 carbon atoms), an aralkyloxy group (e.g., containing 7 to 15 carbon atoms), an aryloxy group (e.g., containing 6 to 12 carbon atoms), a heteroaryloxy group (e.g., containing 2 to 12 carbon atoms), an alkenyloxy group (e.g., containing 3 to 7 carbon atoms), an alkynyloxy group (e.g., containing 2 to 7 carbon atoms), a substituted alkyloxy group (e.g., containing 1 to 6 carbon atoms), an acyloxy group, a sulfonyloxy group, etc., and specifically, reference is made to the descriptions of the substituents described above for the aryl group represented by $A_1$ and $A_2$) or a thio group (e.g., a mercapto group; an alkylthio group (e.g., containing 1 to 6 carbon atoms) such as an ethylthio group, a butylthio group, a cyclohexylthio group, etc.; an aralkylthio group (e.g., containing 7 to 15 carbon atoms) such as a benzylthio group; an alkenylthio group (e.g., containing 3 to 7 carbon atoms) such as an allylthio group; an alkynylthio group (e.g., containing 2 to 7 carbon atoms) such as a propargylthio group; an arylthio group (e.g., containing 6 to 12 carbon atoms) such as a phenylthio group; a heteroarylthio group (e.g., containing 2 to 12 carbon atoms) such as an $\alpha$-pyridylthio group, a 2-benzothiazolylthio group; etc.), provided that at least one of $A_1$ and $A_2$ represents an electron donating aryl group (e.g., an aryl group having an amino group, an oxy group (e.g., an alkoxy group) or a thio group (e.g., an alkylthio group) in a suitable position, i.e., the o- or p-position of a phenyl group, the 2-, 4-, 5- or 7-position of a 1-naphthyl group, and the 1-, 3-, 6- or 8-position of a 2-naphthyl group) or an electron donating hetero ring residue (a residue of a hetero ring having excessive $\pi$ electrons as described in A. Albert, *Heterocyclic Chemistry*, 2nd Edition, Chapters 5 and 6, The Athlone Press (1968), or having an ethylenic carbon-carbon bond as described in A. Albert, Ibid., Chapters 8 and 9, with the position of the residue being a position conjugatable with a hetero atom).

Japanese Patent Publication 24188/63 describes 7-dimethylamino-4,4-bis(p-dimethylaminophenyl)-2-(p-nitrophenyl)4H-3,1-benzoxazine having the structural formula (D):

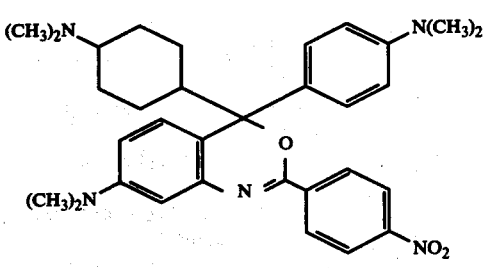

(D)

which might be considered analogous to the thiazine derivatives of the present invention.

However, this oxazine ring is so unstable that a Zwitter-ion structure as shown by the following structural formula (E):

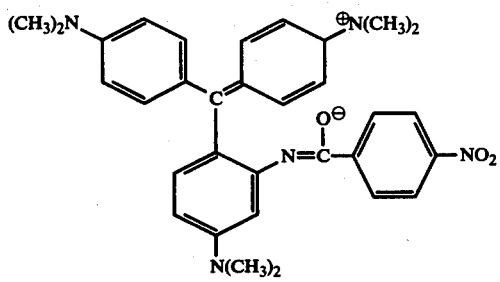

(E)

tends to be formed.

Thus, it is spontaneously colored in air even in the absence of an electron accepting material. Also, this compound has the property of being colored when merely adsorbed on cellulose or a polypeptide. Replacement of the substituent in the 2-position of the oxazine ring in the above structural formula (D) by a phenyl group, a p-anisyl group, a methyl group or the like other than the p-nitrophenyl group does not serve to stabilize the oxazine ring. Therefore, this compound cannot be used as a dye precursor for recording materials. Further, thiazine derivatives described in *Chemical Abstracts*, 70, 87829 U having the following structural formula (F):

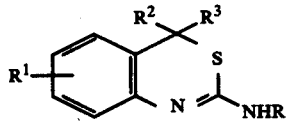

(F)

wherein R represents a hydrogen atom, a methyl group, an ethyl group, an isopropyl group, a $\beta$-diethylaminoethyl group, a benzyl group or a benzoyl group, $R^1$ represents a hydrogen atom or a chlorine atom, $R^2$ and $R^3$ each represents a methyl group, an ethyl group, a propyl group or a phenyl group. They were synthesized as sedatives and do not form color at all when contacted with an electron accepting material such as activated clay, a phenol resin or the like, thus not exhibiting properties as dye precursors. This may be attributed to the fact that $R^2$ and $R^3$ do not contain an electron donating aryl group. It has been quite difficult to predict whether a cleavage of the thiazine ring occurs when the thiazine derivatives of the present invention represented by the general formula (I) are contacted with an electron accepting material to form color.

In addition, even if it was possible to predict that a stable colorless compound could be obtained by changing the lactone ring of aforesaid crystal violet lactone (structural formula (A)) at present most widely used as a dye precursor for recording materials to a thiazine ring and that the resulting compound would form color when contacted with an electron accepting material, it was still impossible to predict that the dye colored with an electron accepting material would have an extremely improved light resistance. Because, it has heretofore generally been believed that the light resistance of dyes greatly depends upon the skeletal structure of the conjugation system (e.g., the triphenylmethane system, the xanthene system, the anthraquinone system, etc.), and therefore, that the light resistance cannot be improved by changing a moiety not greatly participating in the conjugation system.

The thiazine derivatives represented by the general formula (I) can be obtained by oxidizing the thioamido derivatives represented by the following general formula (II), provided that, when Y represents an unsaturated amino group or an amido group, i.e., when general formula (II) is represented by the general formula (II'), the general formula (III) which is in a tautomeric relationship with general formula (I'), the general formula (IV) which is formed by ring-closing in a different manner, and the general formula (V) which is in a tautomeric relationship with the general formula (IV) can be considered.

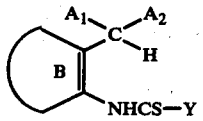
(II)

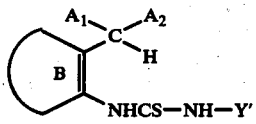
(II')

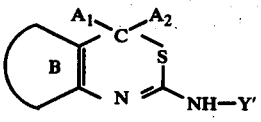
(I')

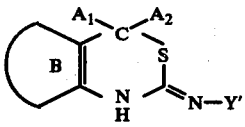
(III)

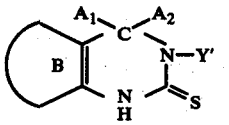
(IV)

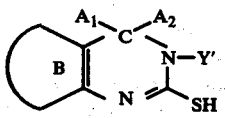
(V)

Furthermore, when Y represents a hydroxy group or a mercapto group, in addition to the general formula (I), the general formula (VI) which is in a tautomeric relationship with the general formula (I), the general formula (VII) formed by ring-closing in a different manner, and the general formula (VIII) which is in a tautomeric relationship with the general formula (VII) can be considered.

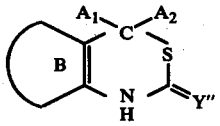
(VI)

(Y'' = O or S)

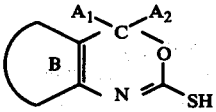
(VII)

-continued

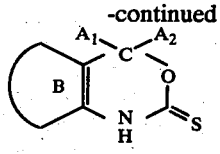
(VIII)

Of the above-described structures other than the general formula (I), IR spectra eliminated the possibility of the general formulae (VII) and (VIII). However, the possibility of the existence of other structures has not been decisively concluded. Therefore, the compounds of the present invention are considered to be inclusively represented by the general formula (I).

Of the thiazine derivatives (color former compounds) to be used in the present invention, typical examples are illustrated below.

(1) 4-H-7-Diethylamino-4,4-bis(p-dimethylaminophenyl)-2-pivaloylamino-3,1-benzothiazine
(2) 4H-7-Diethylamino-4,4-bis(p-dimethylaminophenyl)-2-anilino-3,1-benzothiazine
(3) 4H-7-Dibenzylamino-4,4-bis(p-dimethylaminophenyl)-2-pivaloylamino-3,1-benzothiazine.
(4) 4H-7-Diethylamino-4,4-bis{p-[N-ethyl N-(p-tolyl-)amino]-phenyl}-2-pivaloylamino-3,1-benzothiazine
(5) 4H-7-Dibenzylamino-4,4-bis(p-dimethylaminophenyl)-2-isobutoxycarbonylamino-3,1-benzothiazine
(6) 4H-6-Methyl-4,4-bis(p-dimethylaminophenyl)-2-pivaloylamino-3,1-benzothiazine
(7) 4H-7-Diethylamino-4,4-bis(p-dimethylaminophenyl)-2-phenyl-3,1-benzothiazine
(8) 4H-7-Diethylamino-4,4-bis(p-dimethylaminophenyl)-2-benzoylamino-3,1-benzothiazine
(9) 4H-7-Dimethylamino-4,4-bis(9'-ethyl-3'-methylcarbazol-6'-yl)-2-pivaloylamino-3,1-benzothiazine
(10) 4H-7-Diethylamino-4-(p-diethylaminophenyl)-4-(9'-ethylcarbazol-3'-yl)-2-pivaloylamino-3,1-benzothiazine
(11) 4H-7-Diethylamino-4-(p-diethylaminophenyl)-4-(9'-ethylcarbazol-3'-yl)-2-anilino-3,1-benzothiazine
(12) 4H-6-Methyl-4,4-bis(p-dimethylaminophenyl)-2-ethoxycarbonylamino-3,1-benzothiazine
(13) 4H-7-Diethylamino-4,4-bis(p-dibenzylaminophenyl)-2-pivaloyl-3,1-benzothiazine
(14) 4H-6-Methyl-4,4-bis(p-dimethylaminophenyl)-2-benzoylamino-3,1-benzothiazine
(15) 4H-6-Methyl-4,4-bis(p-dimethylaminophenyl)-2-(p-methoxybenzoylamino)-3,1-benzothiazine
(16) 4,4-bis(p-Dimethylaminophenyl)-2-acetylamino-3,1-benzothiazine
(17) 4H-6,8-Dimethyl-4,4-bis(p-dimethylaminophenyl)-2-pivaloylamino-3,1-benzothiazine
(18) 4H-6-Methyl-4,4-bis(p-dimethylaminophenyl)-2-isobutylamino-3,1-benzothiazine
(19) 4H-6-Methyl-4,4-bis(p-dimethylaminophenyl)-2-butyrylamino-3,1-benzothiazine
(20) 4H-6-Methyl-4,4-bis(p-dimethylaminophenyl)-2-valerylamino-3,1-benzothiazine
(21) 4H-6-Methyl-4,4-bis(p-dimethylaminophenyl)-2-octanoylamino-3,1-benzothiazine
(22) 4H-6-Methyl-4,4-bis(p-dimethylaminophenyl)-2-decanoylamino-3,1-benzothiazine
(23) 4H-6-Methyl-4,4-bis(p-dimethylaminophenyl)-2-dodecanoylamino-3,1-benzothiazine
(24) 4H-6-Methyl-4,4-bis(p-dimethylaminophenyl)-2-tetradecanoylamino-3,1-benzothiazine

(25) 4H-6-Methyl-4,4-bis(p-dimethylaminophenyl)-2-hexadecanoyl-3,1-benzothiazine
(26) 4H-6-Methyl-4,4-bis(p-dimethylaminophenyl)-2-octadecanoylamino-3,1-benzothiazine
(27) 4H-6-Methoxy-4,4-bis(p-dimethylaminophenyl)-2-pivaloylamino-3,1-benzothiazine
(28) 4H-7-Dimethylamino-4,4-bis(p-dimethylaminophenyl)-2-dimethylamino-3,1-benzothiazine
(29) 4H-7-Diethylamino-4,4-bis(p-dimethylaminophenyl)-2-phenoxyacetylamino-3,1-benzothiazine
(30) 4H-7-Diethylamino-4,4-bis(p-dimethylaminophenyl)-2-methylthio-3,1-benzothiazine
(31) 4H-6-Nitro-4,4-bis(p-dimethylaminophenyl)-2-pivaloylamino-3,1-benzothiazine
(32) 4H-6-Chloro-4,4-bis(p-dimethylaminophenyl)-2-ethoxycarbonylamino-3,1-benzothiazine
(33) 4H-6-Ethoxy-4,4-bis(p-dimethylaminophenyl)-2-methoxycarbonylamino-3,1-benzothiazine
(34) 4H-7-Diethylamino-4,4-bis(p-dimethylaminophenyl)-2-methylsulfonylamino-3,1-benzothiazine
(35) 4H-7-Diethylamino-4,4-bis(p-dimethylaminophenyl)-2-(p-tolylsulfonylamino)-3,1-benzothiazine
(36) 4H-7-Diethylamino-4,4-bis(p-dimethylaminophenyl)-2-(dimethylaminosulfonyl)amino-3,1-benzothiazine
(37) 4H-7-Diethylamino-4,4-bis(p-dimethylaminophenyl)-2-ethoxycarbonylamino-3,1-benzothiazine
(38) 4H-7-Diethylamino-4,4-bis(p-dimethylaminophenyl)-2-methoxycarbonylamino-3,1-benzothiazine
(39) 4H-7-Diethylamino-4,4-bis(p-dimethylaminophenyl)-2-phenoxycarbonylamino-3,1-benzothiazine
(40) 4H-7-Diethylamino-4,4-bis{p-[N-ethyl-N-(p-tolyl-)amino]-phenyl}-2-isobutoxycarbonylamino-3,1-benzothiazine
(41) 4H-7-Diethylamino-4,4-bis(p-dimethylaminophenyl)-2-(dimethylaminosulfonyl)amino-3,1-benzothiazine
(42) 4H-7-Diethylamino-4,4-bis(p-dimethylaminophenyl)-2-isobutoxycarbonylamino-3,1-benzothiazine
(43) 4H-7-Diethylamino-4,4-bis(p-dimethylaminophenyl)-2-[2-(2,4-di-t-amylphenoxy)butyrylamino]-3,1-benzothiazine
(44) 4H-7-Diethylamino-4,4-bis(p-dimethylaminophenyl)-2-(N',N'-dimethylureido)-3,1-benzothiazine
(45) 4H-7-Diethylamino-4,4-bis(p-dimethylaminophenyl)-2-isobutylamino-3,1-benzothiazine
(46) 4H-7-Diethylamino-4,4-bis(1-methyl-2-phenylindol-3-yl)-2-pivaloylamino-3,1-benzothiazine
(47) 4H-7-Dipropylamino-4,4-bis(p-dimethylaminophenyl)-2-acetylamino-3,1-benzothiazine
(48) 4H-7-Dibutylamino-4,4-bis(p-dimethylaminophenyl)-2-acetylamino-3,1-benzothiazine
(49) 4H-7-(N-Methyl-N-benzylamino)-4,4-bis(p-dimethylaminophenyl)-2-acetylamino-3,1-benzothiazine
(50) 4H-7-[N-Ethyl-(p-toluidino)]-4,4-bis(p-dimethylaminophenyl)-2-acetylamino-3,1-benzothiazine
(51) 4H-7-bis(Cyanoethyl)amino-4,4-bis(p-dimethylaminophenyl)-2-pivaloylamino-3,1-benzothiazine
(52) 4H-7-bis(Chloroethyl)amino-4,4-bis(p-dimethylaminophenyl)-2-pivaloylamino-3,1-benzothiazine
(53) 4H-7-bis(Hydroxyethyl)amino-4,4-bis(p-diethylaminophenyl)-2-pivaloylamino-3,1-benzothiazine
(54) 4H-7-Diethylamino-4,4-bis(2-methyl-4-diethylaminophenyl)-2-acetylamino-3,1-benzothiazine
(55) 4H-7-Diethylamino-4,4-bis(3-methyl-4-diethylaminophenyl)-2-pivaloylamino-3,1-benzothiazine
(56) 4H-7-Diethylamino-4,4-bis(2-chloro-4-dimethylaminophenyl)-2-pivaloylamino-3,1-benzothiazine
(57) 4H-7-Diethylamino-4,4-bis(3-chloro-4-diethylaminophenyl)-2-pivaloylamino-3,1-benzothiazine
(58) 4H-7-Diethylamino-4,4-bis(2-methoxy-4-dimethylaminophenyl)-2-pivaloylamino-3,1-benzothiazine
(59) 4H-7-Diethylamino-4,4-bis(3-methoxy-4-dimethylaminophenyl)-2-pivaloylamino-3,1-benzothiazine
(60) 4H-7-Diethylamino-4,4-bis(p-dimethylaminophenyl)-2-benzyloxycarbonylamino-3,1-benzothiazine
(61) 4H-7-Diethylamino-4,4-bis(4-dimethylaminonaphthyl)-2-pivaloylamino-3,1-benzothiazine
(62) 4H-7-[N-Ethyl-N-(β-naphthyl)amino]-4,4-bis(p-dimethylaminophenyl)-2-pivaloylamino-3,1-benzothiazine
(63) 4H-7-Dimethylamino-4,4-bis(p-dipropylaminophenyl)-2-pivaloylamino-3,1-benzothiazine
(64) 4H-7-Dimethylamino-4,4-bis(p-dibutylaminophenyl)-2-pivaloylamino-3,1-benzothiazine
(65) 4H-7-Diphenethylamino-4,4-bis(p-dimethylaminophenyl)-2-pivaloylamino-3,1-benzothiazine
(66) 4H-7-bis(p-Chlorobenzyl)amino-4,4-bis(p-dimethylaminophenyl)-2-pivaloylamino-3,1-benzothiazine
(67) 4H-7-bis(o-Chlorobenzyl)amino-4,4-bis(p-dimethylaminophenyl)-2-pivaloylamino-3,1-benzothiazine
(68) 4H-7-bis(p-Isopropylbenzyl)amino-4,4-bis(p-dimethylaminophenyl)-2-pivaloylamino-3,1-benzothiazine
(69) 4H-6-Methoxy-7-diethylamino-4,4-bis(p-dimethylaminophenyl)-2-pivaloylamino-3,1-benzothiazine
(70) 4H-7-Dimethylamino-4,4-bis{p-[N-ethyl(p-bromoanilino)]-phenyl}-2-pivaloylamino-3,1-benzothiazine
(71) 4H-7-Diethylamino-4,4-bis(p-dimethylaminophenyl)-2-(p-tolyl)-3,1-benzothiazine
(72) 4H-7-Diethylamino-4,4-bis(p-dimethylaminophenyl)-2-(o-tolyl)-3,1-benzothiazine
(73) 4H-7-Diethylamino-4,4-bis(p-dimethylaminophenyl)-2-(m-tolyl)-3,1-benzothiazine
(74) 4H-7-Diethylamino-4,4-bis(p-dimethylaminophenyl)-2-(p-chlorophenyl)-3,1-benzothiazine
(75) 4H-7Diethylamino-4,4-bis(p-dimethylaminophenyl)-2-(m-chlorophenyl)-3,1-benzothiazine
(76) 4H-7-Diethylamino-4,4-bis(p-dimethylaminophenyl)-2-(p-fluorophenyl)-3,1-benzothiazine
(77) 4H-7-Diethylamino-4,4-bis(p-dimethylaminophenyl)-2-(3-thienyl)-3,1-benzothiazine
(78) 4H-7-Diethylamino-4,4-bis(p-dimethylaminophenyl)-2-methoxy-3,1-benzothiazine
(79) 4H-7-Diethylamino-4,4-bis(p-dimethylaminophenyl)-2-(p-chloroanilino)-3,1-benzothiazine
(80) 4H-7-Diethylamino-4,4-bis(p-dimethylaminophenyl)-2-(p-dimethylaminoanilino)-3,1-benzothiazine
(81) 4H-7Diethylamino-4,4-bis(p-dimethylaminophenyl)-2-(p-nitroanilino)-3,1-benzothiazine
(82) 4H-7-Diethylamino-4,4-bis(p-dimethylaminophenyl)-2-(p-toluidino)-3,1-benzothiazine
(83) 1H-6-Dimethylamino-1,1-bis(p-dimethylaminophenyl)-3-pivaloylamino-naphtho[2,1-d]-2,4-thiazine
(84) 4H-4,4-bis(p-Dimethylaminophenyl)-2-acetylaminoaphtho-[1,2-d]3,1-thiazine
(85) 4H-6-Phenyl-4,4-bis(p-dimethylaminophenyl)-2-acetylamino-3,1-benzothiazine
(86) 1H-7,8,9,10-Tetrahydro-1,1-bis(p-dimethylaminophenyl)-3-acetylamino-naphtho[2,1-d]-2,4-thiazine
(87) 1H-1,1-bis(p-Dimethylaminophenyl)-3-pivaloylamino-5-methyl-indolino[2,3-d]-2,4-thiazine
(88) 1H-1,1-bis(p-Dimethylaminophenyl)-3-pivaloylamino-furo[2,3-d]-2,4-thiazine

(89) 7H-7,7-bis(p-Dimethylaminophenyl)-5-(N-phenyl-trimethylacetoimidoyl)amino-2-methyl-thiazolo[5,4-d]-6,4-thiazine

(90) 2'-Anilino-6'-diethylamino-2-phenyl-6-methyl-spiro[4H-3,1-benzothiazine-4,9'-xanthene]

(91) 6-Chloro-7'-diethylamino-2-(2-furyl)-3'-methyl-1'-phenyl-spiro[4H-3,1-benzothiazine-4,4'-[4H]chromeno[2,3-C]pyrazole]

(92) 7'-Benzyloxy-2-ethoxycarbonylamino-7-diethylamino-2'-phenyl-spiro[4H-3,1-benzothiazine-4,4'-[4H]chromene]

(93) 3'-Diethylamino-6-methoxy-7'-methyl-2-(2-pyridylamino)spiro[4H-3,1-benzothiazine-4,11'-[11H]benzo[b]thieno[3,2-b]chromene]

The above-illustrated Compounds (9), (11) and (86) to (93) can be represented by the following structural formulae:

(9)

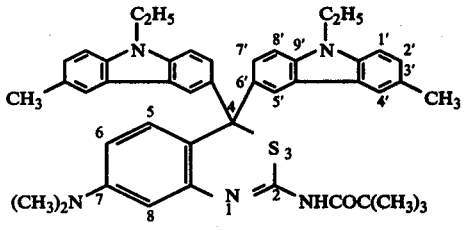

(11)

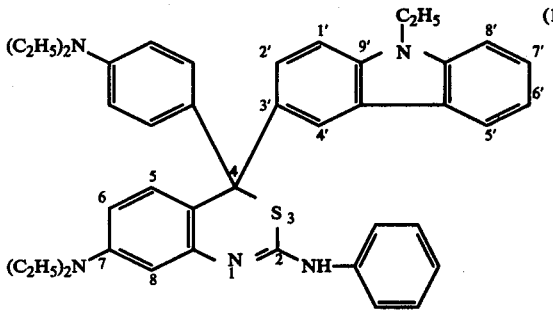

(86)

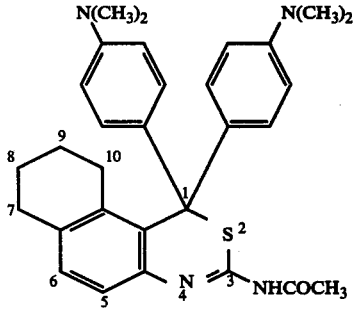

(87)

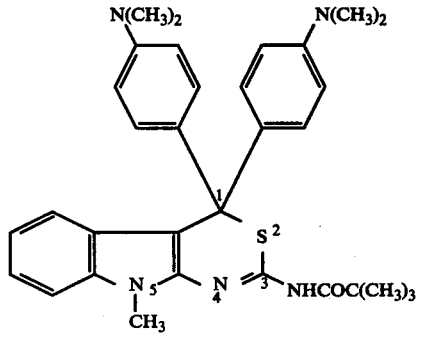

-continued (88)

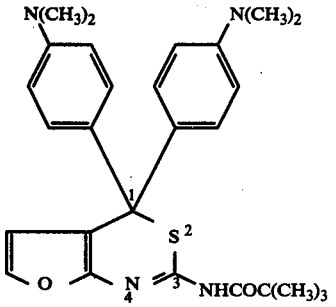

(89)

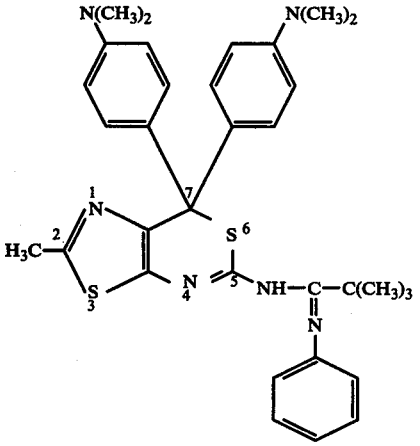

(90)

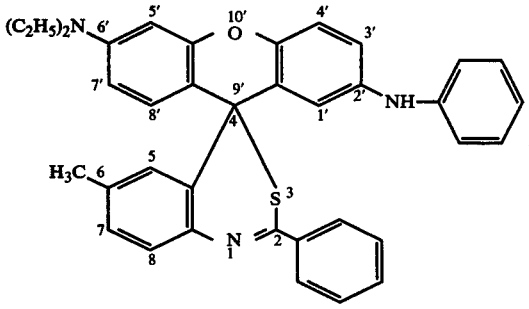

(91)

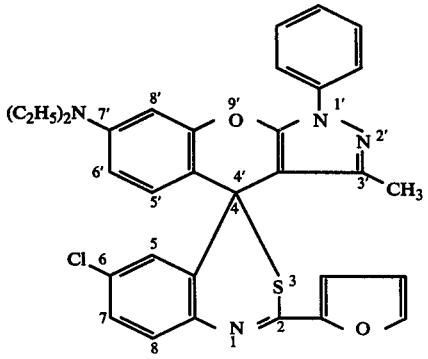

-continued (92)

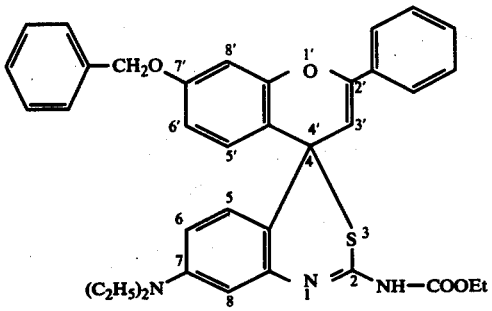

(93)

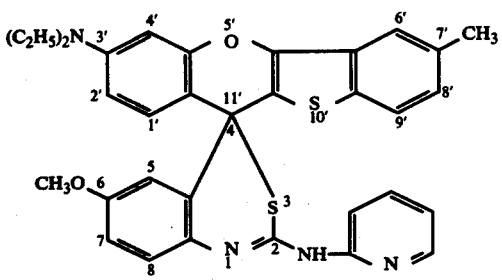

The process for preparing the thiazine derivatives is specifically described below.

There are various processes for oxidizing thioamido derivatives of the foregoing general formula (II). However, as a result of various investigations, it was found preferable to react the thioamido derivatives of the general formula (II) under acidic conditions (e.g., at a pH of below about 7) using a metal oxide such as lead dioxide, manganese dioxide, iron oxide, copper oxide, chromium oxide, cobalt oxide, nickel oxide, etc., quinones such as chloranil (tetrachloroquinone), peroxides such as hydrogen peroxide, organic peracids such as peracetic acid, perbenzoic acid, etc., at about −10° to about 50° C. (about 40° C. to 100° C. when quinones are used) in order to obtain the thiazine derivatives of the general formula (I) in good yield. Suitable acids which can be used to achieve acidic conditions include organic acids such as formic acid, acetic acid, propionic acid, etc., or inorganic acids such as nitric acid, hydrochloric acid, sulfuric acid, phosphoric acid, etc. Lead dioxide and manganese dioxide are particularly preferable as the oxidizing agent and acetic acid and nitric acid are particularly preferable as the acid. Upon conducting the reaction, the acid may also be used as a solvent, or else, a diluting solvent such as water, alcohols (e.g., methanol, ethanol, etc.), ketones (e.g., acetone, methyl ethyl ketone, etc.), aromatic hydrocarbons (e.g., benzene, toluene, etc.), halogenated hydrocarbons (e.g., chloroform, methylenedichloride, etc.) may be used. Of these, water and alcohols often provide good results.

Although an amount of the oxidizing agents used depends upon the kind of oxidizing agent thereof, it is possible to use as a standard a range of from about 1 to about 5 (particularly, 1 to 3) times (equivalent ratio) of the thioamide derivatives as the raw material. These values can be suitably varied depending on the kind of thioamide derivative used. For example, in cases of using manganese dioxide, an amount of from about 1 to about 8 (particularly, 1 to 6) times (equivalent ratio) is preferred.

Further, although the reaction time will vary according to a temperature used, a range of from about 30 minutes to about 3 hours (particularly, 30 minutes to 2 hours) is preferred. In using manganese dioxide, it is sometimes necessary to react for 5 to 6 hours. Whether or not the reaction needs to be continued can be easily determined using paper chromatographic analysis of a portion of the reaction solution by measuring whether raw materials are present or not.

This synthesis is described in more detail in the specification of Copending application Ser. No. 751,874 filed Dec. 17, 1976 (Notice of Allowance dated Apr. 28, 1978) the disclosure of which is incorporated herein by reference.

The process for producing the recording material of the present invention is specifically illustrated below.

The pressure-sensitive copying paper of the present invention can take various forms as described in patents such as U.S. Pat. Nos. 2,505,470, 2,505,471, 2,505,489, 2,548,366, 2,712,507, 2,730,456, 2,730,457, 3,418,250, etc. That is, it can be obtained by dissolving the above-described color formers, individually or in combination or together with another color former(s) in a solvent (e.g., a synthetic oil such as an alkylated naphthalene, an alkylated diphenyl, an alkylated diphenylmethane, an alkylated terphenyl, etc.; a vegetable oil such as cotton oil, castor oil, etc.; an animal oil; a mineral oil; or a mixture thereof) and, after dispersing the solution in a binder or encapsulating the solution in microcapsules, coating on a support such as paper, plastic sheet, resin-coated paper, etc.

The amount of the color former to be used varies depending upon the desired thickness of coating, the form of pressure-sensitive copying paper, the process for the production of the capsules, and like conditions. Therefore, it may appropriately be selected depending on these conditions. It is easy for those skilled in the art to determine the amount of color former to use. In order to encapsulate the color formers in microcapsules, the process utilizing coacervation of a hydrophilic colloid sol as described in U.S. Pat. Nos. 2,800,457 and 2,800,458, or the process of interfacial polymerization as described in British Patents 867,791, 950,443 and 1,091,076 may be used.

A general process for producing the heat-sensitive recording paper of the present invention is described below.

A substantially colorless dye precursor, an electron accepting material and a thermofusible material (to be used when the dye precursor or the electron accepting material does not melt at a suitable temperature, e.g., about 70° to 120° C.) are finely pulverized and admixed into a solution prepared by dissolving or dispersing a binder in a solvent or a dispersing medium, and then coated on a support such as paper, a plastic sheet, a resin-coated paper, etc., then dried to obtain a heat-sensitive recording paper. In preparing the solution mixture, all components may be mixed at the same time initially and pulverized, or may be mixed after pulverizing suitable combinations thereof.

Also, the coating mixture solution may be impregnated in the support.

Further, an opacifying agent can be added and mixed in the above-described mixing.

The amount of each component constituting the heat-sensitive recording paper is as follows: dye precursor: about 1 to about 2 parts by weight; electron accepting material: about 1 to about 6 parts by weight; thermofusible material: about 0 to about 30 parts by weight; binder:

about 1 to about 15 parts by weight; dispersing medium (solvent): about 20 to about 300 parts by weight.

The above-described thiazine derivatives can be used individually or in combination as the dye precursors or may be used together with other known color formers for pressure-sensitive copying papers such as crystal violet lactone or fluoran derivatives. Examples of known color formers which can be used with the color former of the invention are disclosed in U.S. Pat. Nos. 2,548,365, 2,548,366, 3,293,060, 3,501,331, 3,506,471, 3,514,310, 3,551,181, 3,631,064, 3,663,571, 3,681,392, 3,697,540, 3,963,553, etc. The amount of these additional known color formers is optional and can be varied as desired. Organic acids or the metal salts thereof are particularly preferred among those described hereinbefore in this specification as the electron accepting material used in heat-sensitive recording materials. Specific examples of electron accepting materials which can be used are further described in U.S. Pat. Nos. 2,972,547, 3,427,180, 3,455,721, 3,501,331, 3,516,845, 3,554,781, 3,619,238, 3,622,364, 3,625,736, 3,634,121, 3,672,935, 3,669,711, 3,732,120, 3,753,761, 3,772,052, 3,856,553, 3,864,146, 3,864,299, 3,874,895, 3,924,027, 3,983,292, etc.

The dispersing medium (solvent) should scarcely dissolve both the dye precursor and the electron accepting material. If it dissolves either of them, coloration will result.

Therefore, water is the most preferred as a suitable dispersing medium (solvent) and, in addition, hydrocarbons such as hexane, ligroin, petroleum ether, etc., may be used.

Illustrative binders which can be used in the present invention in the above-described embodiments include sytrene-butadiene copolymers, alkyd resins, polybutyl methacrylate, vinyl chloride-vinyl acetate copolymers, styrene-maleic anhydride copolymers, synthetic rubbers, gum arabic, polyvinyl alcohol, hydroxyethyl cellulose, etc. In particular, water soluble binders such as gum arabic, polyvinyl alcohol, hydroxymethyl cellulose, etc., are desirable in connection with the dispersing medium (solvent).

Acetanilide, urea, diphenylamine, diphenyl, naphthalene, benzoin, α-naphthol, β-naphthol, p-t-butylphenol, p-phenylphenol, 4,4'-cyclohexylidenediphenol, 4,4'-isopropylidenediphenol, phthalic anhydride, maleic anhydride, stearic acid, benzoic acid, α-naphthylacetic acid, p-hydroxybenzoic acid methyl ester, diphenyl phthalate, triphenyl phosphate, p-hydroxydiphenyl ether, 2,2-bis[4-(β-hydroxyethoxy)phenol]propane, p-bis(β-hydroxyethoxy)benzene, etc., can be used as the thermofusible material.

These materials are colorless or slightly colored solids at ordinary temperature, e.g., about 25° C., and have a sharp melting point at a heating temperature suitable for copying, i.e., about 50 to about 180° C. On melting, they dissolve at least one of the dye precursor and the electron accepting material, and desirably dissolve both of them.

Opacifying agents which may be used in the present invention include titanium oxide, zinc oxide, barium sulfate, calcium sulfate, starch, etc.

An electrothermic heat-sensitive recording paper of the present invention can be prepared by coating on a support such as paper a solution prepared by dispersing an electroconductive material such as cuprous iodide, etc., a dye precursor and an electron accepting material together with a binder in a dispersing medium which scarcely dissolves the dye precursor and the electron accepting material, such as water, or by coating an electroconductive material on a support to form a conductive layer and coating thereon a solution prepared by dispersing the dye precursor and the electron accepting material in water or the like. Additionally, where both the dye precursor and the electron accepting material are not melted at a suitable temperature (generally about 70 to about 120° C.), sensitivity to Joule heat generated by the application of electrical energy can be adjusted by adding a thermofusible material (e.g., as described hereinbefore) which can be melted at the suitable temperature and can dissolve at least one of the dye precursor and the electron accepting material.

As the electron accepting material and the thermofusible material which can be used in preparing the electrothermic heat-sensitive recording paper, those which are described with respect to the preparation of the heat-sensitive recording paper can also be used.

Suitable coating amounts of the materials used in producing the embodiments described above are set forth below. These values should be considered as merely exemplary and not limiting, however.

| | Coating Amount (g/m²) | | | | |
|---|---|---|---|---|---|
| | Color Former | Color Developer | Thermo-fusible Material | Electro-conductive Agent | Binder |
| Pressure-sensitive paper | 0.03 to 0.2 | 0.4 to 4 | — | — | 0.6 to 1 |
| Heat-sensitive paper | 0.1 to 1 | 0.5 to 5 | 0 to 5 | — | 1 to 3 |
| Electrothermic heat-sensitive paper | 0.1 to 1 | 0.5 to 5 | 0 to 5 | 10 to 40 | 3 to 12 |

Light-sensitive recording sheets of the present invention can be prepared by using the thiazine derivatives of the present invention in place of the dye precursors used in Japanese Patent Publications 24188/63, 10550/70, 13258/70, 204/74, 6212/74, 28449/74, Japanese Patent Applications (OPI) 31615/72, 32532/73, 9227/74, 135617/74, 80120/75, 87317/75, 126228/75, etc., such as lactone compounds, lactam compounds, spiropyran compounds, carbinol compounds, ethylene compounds, leucoauramine compounds, oxazine compounds, etc.

More specifically, 2 to 10 parts of a compound capable of forming an electron accepting material, 1 to 2 parts of color former and 1 to 6 parts of a binder (e.g., a binder as described above for a heat-sensitive paper) is dispersed or partially dissolved in 60 to 300 parts of water or an organic solvent (e.g., ligroin, toluene, ethyl acetate, etc.), and then, the thus obtained solution is coated on a support (e.g., baryta paper, resin-coated paper, polyethylene terephthalate film) to provide a light-sensitive recording sheet, wherein the coated amount of the compound capable of forming an electron accepting material is about 0.5 to about 5 g/m$^2$, the coated amount of the color former is about 0.1 to about 1 g/m$^2$ and the coated amount of the binder is about 0.6 to about 3 g/m$^2$.

The thus obtained light-sensitive recording sheet is irradiated with, e.g., a mercury lamp (500 w, at a distance from the lamp to the sheet of about 15 cm) for 10 seconds to 3 minutes (the irradiation time can vary widely depending on the kind of compound capable of forming an electron accepting material used). Thus, a color is formed in the exposed part of the sheet and no color results in the unexposed part. Suitable fixing techniques for the image thus formed will depend on the kind of compound capable of forming an electron accepting material used. Suitable fixing techniques include a heat treatment (e.g., at about 80 to about 150° C. for about 1 to about 3 minutes) or an organic solvent treatment (e.g., using ligroin, toluene, ethyl acetate, etc.) in which the compound capable of forming an electron accepting material is sublimed or dissolved therefrom, respectively.

Other recording materials can also be prepared using the thiazine derivatives of the present invention in place of the conventional dye precursors.

The following examples are given to illustrate the present invention in greater detail. Unless otherwise indicated, all parts, percents, ratios and the like are by weight.

EXAMPLE 1

1 part of color former Compound (1) of the present invention described above was dissolved in 30 parts of alkylated naphthalene. This solution was added to 50 parts of water containing dissolved therein 6 parts of gelatin and 4 parts of gum arabic under vigorous stirring for emulsification. When the diameter of the oil droplets become 1 micron to 10 microns, 250 parts of water was added thereto. The pH of the solution was adjusted to about 4 by adding acetic acid incrementally to cause coacervation and form a wall of gelatin and gum arabic around the oil droplets. Then, formaldehyde was added thereto, followed by increasing the pH to 9 to harden the wall formed.

The thus obtained microcapsule dispersion was coated on a paper and dried. When this paper was brought into contact with a paper coated with an acidic clay (e.g., activated clay, acidic clay, attapulgite, etc.), a phenol resin, 4,4'-isopropylidenediphenol, zinc 3,5-bis-(α-methylbenzyl)salicylate, zinc p-toluenesulfonate, 2,2'-methylenebisphenol, etc., and pressure or impact was applied thereto, a blue printed image was instantly formed. This image had a high color density and had an excellent light resistance and heat resistance.

EXAMPLE 2

In the same manner as described in Example 1 except for using color former Compounds (2) to (93) in place of the thiazine derivative, Compound (1) used in Example 1, pressure-sensitive copying papers were obtained which could be used to rapidly form colored letters or color images which had a high color density and which had excellent light resistance and heat resistance.

EXAMPLE 3

The maximum absorption wavelengths and light resistance values of the colors formed by applying pressure to a pressure-sensitive copying papers superposed on a paper coated with acid clay or active clay are shown below.

The light resistance value was indicated in terms of the values determined according to the following formula:

$$\frac{\text{Density after Irradiating with UV Light for 3 Hours}}{\text{Density 1 Day after Coloration}} \times 100$$

The density was measured using a reflection type density measuring device. As a reference, the value of crystal violet lactone was measured. By comparing this value, it can be understood that thiazine compounds of the invention are better than crystal violet lactone which has been believed to be the most excellent in the art.

| Compound of the General Formula (I) | Maximum Absorption Wavelength (nm) | Light Resistance |
|---|---|---|
| Control (crystal violet lactone) | 610 | 29 |
| 1 | 625 | 55 |
| 2 | 620 | 57 |
| 3 | 615 | 49 |
| 4 | 620 | 78 |
| 5 | 630 | 49 |
| 6 | 655 | 62 |
| 7 | 620 | 102 |
| 9 | 630 | 72 |
| 10 | 630 | 55 |
| 14 | 650 | 50 |
| 15 | 650 | 62 |
| 16 | 660 | 62 |
| 21 | 650 | 75 |
| 22 | 650 | 81 |
| 23 | 650 | 79 |
| 27 | 650 | 76 |
| 42 | 630 | 53 |
| 43 | 620 | 53 |

EXAMPLE 4

30 g of color former Compound (5) of the present invention was mixed with 150 g of a 10% polyvinyl alcohol (PVA117, made by Kuraray Co., Ltd., degree of saponification: 96–98%; average molecular weight: 1,700; hereinafter the same) aqueous solution and 70 g of water and pulverized for 2 hours to prepare a dispersion. The particle size after pulverizing was about 5 microns (Component A).

On the other hand, 30 g of bisphenol A (4,4'-isopropylidenediphenol), 30 g of acetanilide, 150 g of a 10% polyvinyl alcohol aqueous solution and 55 g of water were mixed and pulverized for 2 hours to prepare a dispersion. The particle size of the insolubles after pulverizing was about 5 microns (Component B).

Then, 5 g of Component A and 40 g of Component B were mixed with each other, and coated on a paper to obtain a heat-sensitive recording paper.

When this heat-sensitive recording paper was heated with a heat pen or the like, a blue color was formed. In addition, when this heat-sensitive recording paper was superposed on an original and heated using a thermally developing copying machine, a blue copied image was obtained. The thus obtained color image was so stable against light that scarcely any change in hue and color density occurred even when the color image was irradiated for 1 hour using an ultraviolet ray lamp.

EXAMPLE 5

200 parts of cuprous iodide was added to 200 parts of a 1% by weight polyvinyl alcohol aqueous solution, and mixed and pulverized for 24 hours using a ball mill. The resulting dispersion was coated on an art paper using a coating rod, and dried to form a conductive layer.

Then, 35 parts of color former Compound (90) of the present invention (as a dye precursor) and 35 parts of 4,4'-isopropylidenediphenol (as an electron accepting material) were added to 400 parts of a 10% by weight polyvinyl alcohol aqueous solution, and mixed and pulverized for 24 hours using a ball mill to obtain an almost colorless dispersion. This dispersion was coated on the conductive layer, previously formed on the art paper, using a coating rod previously adjusted to form a layer of about 8 microns in thickness, and dried to obtain an electrothermic heat-sensitive recording paper.

When the paper thus prepared was scanned with a recording needle electrode of tungsten wire (0.25 mm in diameter) at a velocity of 540 mm/sec while applying an AC potential of 300 v to the electrode, a violet-black image of a reflection density of 0.84 was obtained. This color image had light resistance about 3 times that of images formed from crystal violet lactone conventionally used. In comparison with the case of using 2-anilino-6-diethylamino-3-methylfluoran also conventionally used, this color image had excellent light resistance and fog prevention.

EXAMPLE 6

5 g of color former Compound (4) of the present invention was dissolved in 40 ml of chloroform, and 40 ml of a 10% benzene solution of polystyrene was added thereto. After stirring well, 5 g of carbon tetrabromide was added thereto in a dark room and uniformly dissolved.

The resulting solution was coated on a polyethylenecoated paper in a dark room and dried at room temperature (about 20°-30° C.).

When this light-sensitive paper was irradiated with ultraviolet rays, a blue color was formed. This image was fixed by washing with n-hexane, and the unexposed areas were not colored any more even when light was directed thereonto for a long period of time.

Irradiation of this light-sensitive paper with ultraviolet rays while superposing thereon an original drawn on a transparent plastic base provided a blue reversal image with respect to the original.

Fogging did not occur with this light-sensitive paper before being exposed to light, and the properties of the formed color image were extremely excellent. In particular, color reaction materials (dye precursors) described in Japanese Patent Publication 24188/63 were markedly inferior to the thiazine derivatives of the present invention in light resistance and color density.

EXAMPLE 7

In the same manner as in Examples 1 of the patents set forth in the parentheses below, except for using the thiazine derivatives of the present invention (color former Compounds (1), (2), (3) and (4)) in place of conventional dye precursors, an ultrasonic wave recording paper (French Pat. No. 2,120,922), an electron beam recording material (Belgian Pat. No. 7,959,986), a light-sensitive printing plate material (Japanese Patent Application (OPI) 12104/73), a color former ink (Japanese Patent Publication 10766/72), a typewriter ribbon (Japanese Patent Application (OPI) 3713/74), an ink for a ball point pen (Japanese Patent Application (OPI) 83924/73), and a crayon (U.S. Pat. No. 3,769,045), particularly excellent in light resistance were obtained.

While the invention has been described in detail and with reference to specific embodiments thereof, it will be apparent to one skilled in the art that various changes and modifications can be made therein without departing from the spirit and scope thereof.

What is claimed is:

1. A recording material comprising (1) at least one thiazine compound capable of forming a color when contacted with an electron accepting material and represented by the following general formula (I):

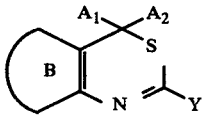

(I)

wherein $A_1$ and $A_2$ may be the same or different and represent an aryl group or a 5 or 6-membered hetero ring residue containing a hetero atom selected from the group consisting of oxygen, sulfur and nitrogen atoms and at least one of $A_1$ and $A_2$ representing an electron donating heterocyclic ring or an electron donating fluorene ring or an aryl group substituted with an amino group; or $A_1$ and $A_2$ combine to form an electron donating hetero ring;

ring B represents an aromatic hydrocarbon ring or a hetero ring;

and Y represents a hydrogen atom, an alkyl group, an arylalkyl group, an alkyenyl group, an alkynyl group, an aryl group, a hetero ring residue, an amino group, an amido group, a hydroxy group or a thio group; and (2) an electron accepting material.

2. The recording material of claim 1, wherein one of $A_1$ and $A_2$ represents an electron donating heterocyclic ring or an aryl group substituted with an amino group and the other represents a phenyl group, a naphthyl group, or a biphenylyl group, which may be unsubstituted or substituted with one or more of an alkyl group, a fluoroalkyl group, an aralkyl group, a halogen atom, an alkoxy group, an aralkyloxy group, an aryloxy group, a heteroaryloxy group, an alkenyloxy group, an alkynyloxy group, an acyloxy group, a sulfonyloxy group, an amino group, an amido group, or a thio group.

3. The recording material of claim 1, wherein said hetero ring formed by $A_1$ and $A_2$ when taken together is a 9H-xanthene ring, a 10-alkyl-9,10-dihydroacridine ring, a 9H-thioxanthene ring, a 1-alkyl-4H-chromeno[2,3-C]pyrazole ring, a 11H-benzo[b]-thieno[3,2-b]chromene ring, a 6-alkyl-5-oxo-5,6-dihydro-12H-chromeno[2,3-C]isoquinoline ring, a 4H-chromene ring, or a 2H-chromene ring and said hetero ring and said fluorene ring may be unsubstituted or substituted with one or more of an alkyl group, a fluoroalkyl group, an aralkyl group, a halogen atom, an alkoxy group, an aralkyloxy group, an aryloxy group, a heteroaryloxy group, an alkenyloxy group, an alkynyloxy group, an acyloxy group, a sulfonyloxy group, an amino group, an amido group or a thio group.

4. The recording material of claim 1, wherein said substituent an amino group, an oxy group, or a thio group in a said electron donating hetero ring residue is a hetero ring having an excess of $\pi$ electrons or is a residue of a hetero ring having an ethylenic carbon-carbon double bond in a position with respect to the hetero ring residue conjugatable with a hetero atom in said hetero ring residue.

5. The recording material of claim 1, wherein said recording material comprises a support having thereon said thiazine compound represented by the general formula (I) dissolved in a solvent and encapsulated in microcapsules coated as a layer on said support and said electron accepting material is coated on the same surface of said support or on the opposite surface of said support or is coated on another support.

6. The recording material of claim 1, wherein said recording material comprises a support having thereon said thiazine compound represented by the general formula (I) and a thermofusible material dispersed in a binder and coated on said support and said electron accepting material is coated on the same surface of said support or on the opposite surface of said support or is coated on another support.

7. The recording material of claim 6, wherein said binder containing said thiazine compound represented by the general formula (I) and said thermofusible material also contains an electroconductive material.

8. The recording material of claim 1 wherein $A_1$ and $A_2$ represent an aryl group substituted with an amino group.

9. The recording material of claim 8 wherein said amino group substituting said aryl group is selected from the group consisting of an anilino group, an ethylamino group, a benzylamino group, an allylamino group, a propargylamino group, a cyclohexylamino group, an acetonylamino group, an ethoxycarbonylmethylamino group, a $\beta$-methoxyethylamino group, a dimethylamino group, a diethylamino group, a dibenzylamino group, a bis(ethoxymethyl)amino group, a bis($\beta$-chloroethyl)amino group, a bis($\beta$-cyanoethyl-)amino group, an N-benzyl-N-ethylamino group, an N-ethyl-N-(p-tolyl)amino group, an N-benzyl-N-($\beta$-ethoxyethyl)amino group, an N-methyl-N-phenacylamino group, a morpholino group, a piperidino group, a pyrrolidino group, an $\alpha$-pyridylamino group, a $\beta$-furylamino group, an $\alpha$-thienylamino group, and a 2-pyrimidinylamino group.

10. The recording material of claim 8 wherein B forms a benzene ring and Y represents an amino group.

11. The recording material of claim 1 wherein $A_1$ and $A_2$ represent a 5- or 6-electron donating hetero ring residue.

12. The recording material of claim 11 wherein said heterocyclic ring represented by $A_1$ and $A_2$ is selected from the group consisting of p-julolidyl, 1,2,3,4-tetrahydroquinolin-6-yl, 3,3-dimethylindolin-5-yl, 3,4-methylenedioxypehnyl, 1,2-dimethyl-5-benzimidazolyl, 10-ethylphenothiazin-3-yl, 10-ethylphenoxazin-3-yl, 9-ethylcarbazol-3-yl, dibenzofuran3-yl, dibenzothiophen-3-yl, quinolin-8-yl, 1,2-dimethylindol-3-yl, 1-ethylindazol-3-yl, benzo[b]furan-3-yl, benzo[b]thiophen-3-yl, 1-ethylpyrrol-3-yl, 3-furyl, 3-thienyl, 2-thiazolyl, 2-benzoxazolyl, 2-pyridyl, and 4-quinolyl.

13. The recording material of claim 1 wherein $A_1$ and $A_2$ combine to form an electron donating hetero ring.

14. The recording material of claim 13, wherein said hetero ring formed by $A_1$ and $A_2$ when taken together is a 9H-xanthene ring, a 10-alkyl-9,10-dihydroacridine ring, a 9H-thioxanthene ring, a 1-alkyl-4H-chromeno[2,3-C]pyrazole ring, a 11H-benzo[b]-thieno[3,2-b]chromene ring, a 6-alkyl-5-oxo-5,6-dihydro-12H-chromeno[2,3-C]isoquinoline ring, a 4H-chromene ring, or a 2H-chromene ring and said hetero ring and said fluorene ring may be unsubstituted or substituted with one or more of an alkyl group, a fluoroalkyl group, an aralkyl group, a halogen atom, an alkoxy group, an aralkyloxy group, an aryloxy group, a heteroaryloxy group, an alkenyloxy group, an alkynyloxy group, an acyloxy group, a sulfonyloxy group, an amino group, an amido group or a thio group.

15. The recording material of claim 1 wherein said amino group substituting said aryl group is selected from the group consisting of an anilino group, an ethylamino group, a benzylamino group, an allylamino group, a propargylamino group, a cyclohexylamino group, an acetonylamino group, an ethoxycarbonylmethylamino group, a $\beta$-methoxyethylamino group, a dimethylamino group, a diethylamino group, a dibenzylamino group, a bis(ethoxymethyl)amino group, a bis($\beta$-chloroethyl)amino group, a bis($\beta$-cyanoethyl-)amino group, an N-benzyl-N-ethylamino group, an N-ethyl-N-(p-tolyl)amino group, an N-benzyl-N-($\beta$-ethoxyethyl)amino group, an N-methyl-N-phenacylamino group, a morpholino group, a piperidino group, a pyrrolidino group, an $\alpha$-pyridylamino group, a $\beta$-furylamino group, an $\alpha$-thienylamino group, and a 2-pyrimidinylamino group.

16. The recording material of claim 1 wherein said heterocyclic ring represented by $A_1$ and $A_2$ is selected from the group consisting of p-julolidyl, 1,2,3,4-tetrahydroquinolin-6-yl, 3,3-dimethylindolin-5-yl, 3,4-methylenedioxyphenyl, 1,2-dimethyl-5-benzimidazolyl, 10-ethylphenothiazin-3-yl, 10-ethylphenoxazin-3-yl, 9-ethylcarbazol-3-yl, dibenzofuran-3-yl, dibenzothiophen-3-yl, quinolin-8-yl, 1,2-dimethylindol-3-yl, 1-ethylindazol-3-yl, benzo[b]furan-3-yl, benzo[b]thiophen3-yl, 1-ethylpyrrol-3-yl, 3-furyl, 3-thienyl, 2-thiazolyl, 2-benzoxazolyl, 2-pyridyl, and 4-quinolyl.

* * * * *